US006257235B1

(12) United States Patent
Bowen

(10) Patent No.: US 6,257,235 B1
(45) Date of Patent: Jul. 10, 2001

(54) FACE MASK WITH FAN ATTACHMENT

(75) Inventor: Michael L. Bowen, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/325,940

(22) Filed: May 28, 1999

(51) Int. Cl.[7] ..... A62B 18/02
(52) U.S. Cl. ..... 128/206.21; 128/206.12
(58) Field of Search ..... 128/206.23, 206.22, 128/206.17, 203.23, 203.24, 203.28, 205.13, 205.14, 205.15, 205.16, 205.24, 205.25, 201.17, 201.25, 863, 201.22, 201.28, 201.29, 205.27, 206.12, 206.13, 206.14, 206.16, 206.19, 206.21, 206.24, 206.28, 207.11, 200.27, 200.28, 201.15

(56) References Cited

U.S. PATENT DOCUMENTS

| | | | |
|---|---|---|---|
| H1072 | 7/1992 | Estes et al. . | |
| D. 396,340 | 7/1998 | She . | |
| 3,649,964 | 3/1972 | Schoelz et al. . | |
| 3,822,698 | 7/1974 | Guy . | |
| 4,055,173 | 10/1977 | Knab . | |
| 4,233,972 | 11/1980 | Hauff et al. . | |
| 4,250,577 | 2/1981 | Smith . | |
| 4,280,491 | 7/1981 | Berg et al. . | |
| 4,320,755 | 3/1982 | Flint et al. . | |
| 4,323,063 | 4/1982 | Fisichella . | |
| 4,412,537 | 11/1983 | Tiger . | |
| 4,430,995 | 2/1984 | Hilton . | |
| 4,440,163 | 4/1984 | Spergel . | |
| 4,462,399 | 7/1984 | Braun . | |
| 4,475,248 | 10/1984 | L'Abbe et al. . | |
| 4,498,202 | 2/1985 | Yamamoto . | |
| 4,502,480 | 3/1985 | Yamamoto . | |
| 4,848,366 * | 7/1989 | Aita et al. | 128/863 |
| 4,886,056 | 12/1989 | Simpson . | |
| 4,899,740 | 2/1990 | Napolitano . | |
| 4,901,716 | 2/1990 | Stackhouse et al. . | |
| 4,905,687 | 3/1990 | Ponkala . | |
| 4,951,662 | 8/1990 | Townsend, Jr. . | |
| 4,965,887 | 10/1990 | Paoluccio et al. . | |
| 4,971,052 | 11/1990 | Edwards . | |
| 5,042,474 | 8/1991 | Williamson . | |
| 5,048,516 | 9/1991 | Soderberg . | |
| 5,054,479 | 10/1991 | Yelland et al. . | |
| 5,085,231 * | 2/1992 | Johnson | 131/329 |
| 5,165,395 | 11/1992 | Ricci . | |

(List continued on next page.)

FOREIGN PATENT DOCUMENTS

| | | |
|---|---|---|
| 352938B1 | 1/1990 | (EP) . |
| 363530A1 | 4/1990 | (EP) . |
| 621056B1 | 10/1994 | (EP) . |
| 2072516 | 10/1981 | (GB) . |
| 98/14080 | 4/1998 | (WO) . |

OTHER PUBLICATIONS

EPO Search Report dated Aug. 30, 2000.

*Primary Examiner*—Aaron J. Lewis
*Assistant Examiner*—Teena Mitchell
(74) *Attorney, Agent, or Firm*—Dority & Manning, P.A.

(57) ABSTRACT

A face mask is provided having a filter body sized to cover the nose and mouth of a wearer, a securing mechanism for holding the filter body in close fit with the wearer's face, and a fan attachment to enhance breathability and comfort of the mask. The fan is powered and configured with the exterior of the filter body to aid in drawing air through the filter media of the mask. The fan operates to draw warm, moist exhaled air from the interior volume of the mask to improve comfort, facilitate inhalation, and decrease fogging of any transparent portions of the mask or eye coverings. The fan may additionally operate to force cool, fresh air into the interior volume of the mask, also for the comfort of the wearer.

23 Claims, 3 Drawing Sheets

U.S. PATENT DOCUMENTS

| | | |
|---|---|---|
| 5,193,347 | 3/1993 | Apisdorf . |
| 5,245,994 | 9/1993 | Chang et al. . |
| 5,303,701 | 4/1994 | Heins et al. . |
| 5,318,020 | 6/1994 | Schegerin . |
| 5,322,059 | 6/1994 | Walther . |
| 5,322,061 | 6/1998 | Brunson . |
| 5,331,957 | 7/1994 | Liu . |
| 5,372,130 | 12/1994 | Stern et al. . |
| 5,394,870 | 3/1995 | Johansson . |
| 5,404,874 | 4/1995 | Meier . |
| 5,419,318 | 5/1995 | Tayebi . |
| 5,526,805 | 6/1996 | Lutz et al. . |
| 5,533,500 | 7/1996 | Her Mou . |
| 5,561,863 | 10/1996 | Carlson, II . |
| 5,577,495 | 11/1996 | Murphy . |
| 5,592,935 | 1/1997 | Elstran et al. . |
| 5,592,936 | 1/1997 | Thomas, Jr. et al. . |
| 5,694,923 | 12/1997 | Hete et al. . |

* cited by examiner

FACE MASK WITH FAN ATTACHMENT

BACKGROUND OF THE INVENTION

The present invention relates generally to a face mask providing a covering for the nose and mouth of a wearer, and more particularly to a face mask with a fan attachment for drawing air through the filter body of the mask.

Disposable face masks and respirators are well known in the art. In the medical field, such masks are used in preventing contamination of a patient by the exhaled breath of healthcare personnel. In recent years, with increased concern for infection of healthcare personnel by airborne pathogens, such masks have become important in preventing infection of healthcare personnel as well.

Healthcare personnel now increasingly show a preference for wearing face masks which form a barrier or seal between the periphery of the mask and the face of the wearer. As a result of this sealing engagement between the mask and wearer's skin, substantially all air inhaled or exhaled by the wearer is forced to flow through the filter media of the face mask. As a result, these better-fitting filter masks can become hot and uncomfortable to the wearer during periods of long-term wear. Breathability can also be a problem.

In certain healthcare environments, there is a preference towards including transparent panels in face masks through which the wearer's face can be seen. These panels allow improved communication between healthcare personnel and patients by allowing the patient to see the mouth of the healthcare worker, and are particularly beneficial for serving hearing impaired patients. Such masks with transparent panels often have a problem with condensation because the warm, moist air exhaled by the wearer causes the panel to fog with moisture vapor. A similar condensation problem can occur when the face mask wearer must also wear eyeglasses or goggles.

The use of face masks with the noted associated problems is not restricted to the healthcare environment. Many industrial applications, such as handling hazardous materials or working in a clean room environment, also require the use of face masks and respirators that form a substantially tight seal between the face of the wearer and the periphery of the mask.

Accordingly, it can be seen that a need exists for a face mask design which provides increased air flow through the filter media of the mask by forcing exhaled air from the interior of the mask and delivering fresh air from the exterior of the mask.

SUMMARY OF THE INVENTION

The present invention recognizes and addresses the foregoing disadvantages, and others, of prior art construction and methods.

Objects and advantages of the invention will be set forth in part in the following description, or may be obvious from the description, or may be learned through practice of the invention.

In accordance with the invention, a face mask is provided having a filter body to cover at least the nose and mouth of a wearer and defining an interior air volume surrounding the wearer's nose and mouth. The face mask also includes a mechanism for holding the mask securely on the wearer's face. A fan is disposed on the outside of the filter body which can operate to draw at least a portion of its air flow through the filter body of the mask.

In one desired embodiment, the filter body of the face mask forms a substantially tight seal with the face of the wearer when in use. The mechanism for securing the mask to the face of the wearer aids in holding the periphery of the mask in this sealing engagement with the skin. The securing device may be any conventional device, including tie straps or elastic straps to go around the back or top of the wearer's head, ear loops, or the like.

The fan may be operational in a direction to draw air exhaled by the wearer from within the interior air volume of the mask, effectively removing the hot, moist breath of the wearer and allowing the wearer to inhale with greater ease. Removal of exhaled air also helps prevent fogging of eyeglasses and any clear portion of the mask.

In another embodiment, the fan is reversible and thus may be configured to either draw exhaled air out of the interior volume of the mask or draw cool, fresh air into the interior volume of the mask providing greater comfort to the wearer.

The fan may be powered using a power supply such as batteries or other access to electrical current. The power supply may be portable and have the ability to be remotely positioned away from the fan and mask, for instance, attached to the wearer's belt.

In another embodiment, the fan may be connected to an electrical supply provided in hospital operating rooms or other facility.

The power supply for the fan may be included in a fan controller which allows the fan to be turned on and off. The controller may also have the ability to be remotely positioned from the fan and mask for comfort and convenience. The controller may also allow selection of the speed for the fan as well as its operational direction if the fan is reversible.

In one embodiment, the fan may be permanently affixed to the exterior surface of the mask using means such as an adhesive and like. In another embodiment, the fan may be removably secured to the exterior surface of the mask using snaps, a pocket of material, or similar securing mechanisms. This embodiment allows the fan to be reusable on any number of disposable face masks.

In one desirable embodiment, the fan is attached directly adjacent to the filter media of the face mask. The fan may also include an air filter to further enhance filtering of the air forced through the mask by the fan. The further air filter may be particularly beneficial in an embodiment in which the portion of the filter body adjacent to the fan has a differing filter capability from the rest of the mask. For instance, the fan may be attached to a portion of the filter body with enlarged perforations. Alternatively, the fan may be sealed into a port in the filter body of the mask.

The filter body of the mask may include an upper portion with a top edge arranged to extend across the nose and cheeks of the wearer and a lower portion having a bottom edge arranged to extend under the chin of the wearer, with the fan disposed on the lower portion. In one embodiment, the upper and lower portions of the mask may be of generally trapezoidal shape with the longer top and bottom edges forming the periphery of the mask to be held in substantially sealing engagement with the wearer's face, the upper and lower portions of the mask joined together along the remaining edges. Any number of configurations of the filter body are within the scope of the invention.

The filter body of the mask may also include a panel of transparent material to allow the wearer's mouth to be seen through the mask. In this embodiment, the fan prevents condensation from forming on the transparent portion of the mask by drawing moist, exhaled air from the interior volume of the mask.

It should be appreciated by those skilled in the art that the present invention has many applications in the medical field and in industrial environments. The invention can be adapted to a wide variety of face masks. Other features and aspects of the present invention are discussed in greater detail below.

The accompanying drawings, which are incorporated in and constitute a part of this specification, illustrate a number of embodiments of the invention and, together with the description, serve to explain the principles of the invention.

BRIEF DESCRIPTION OF THE DRAWINGS

A full and enabling disclosure of the present invention, including the best mode thereof and directed to one of ordinary skill in the art, is set forth in the specification, which makes reference to the appended drawings, in which.

Figure 1A:
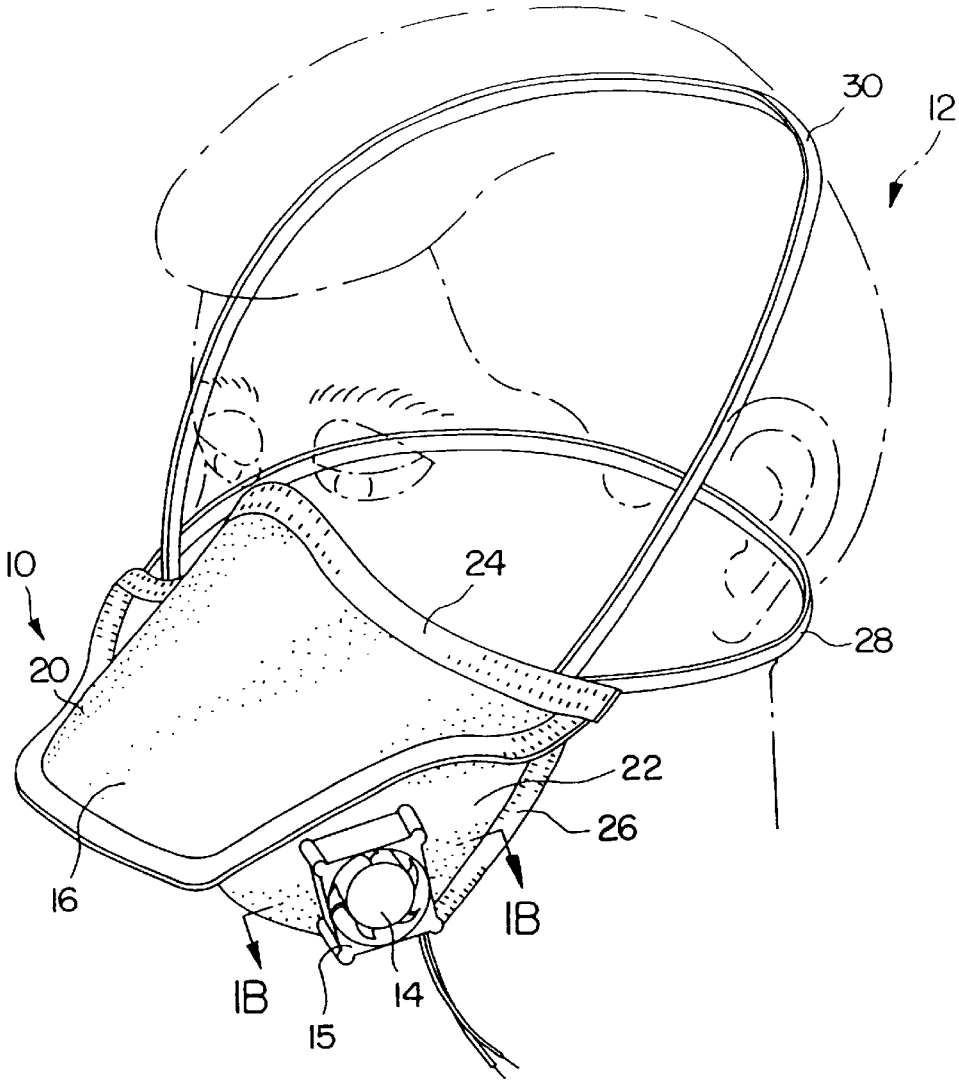
FIG. 1A is a perspective view of a face mask with fan attachment designed in accordance with the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to the presently preferred embodiments of the present invention, one or more examples of which are illustrated in the drawings. Each example is provided for explanation of the invention and is not meant as a limitation of the invention. For example, features illustrated or described as part of one embodiment can be used with another embodiment to create still a third embodiment. It is intended that the present invention cover such modifications and variations as come within the scope and spirit of the invention.

Referring to the figures in general, face masks 10, 110, and 210 are illustrated, positioned on the face of a wearer 12 and including an attached fan 14. As described herein, the face masks can be used to prevent or retard the flow of airborne pathogens, particulate matter, or hazardous materials from the exterior of the masks to the nose and mouth of the wearer 12. Additionally, the masks may prevent bacteria and other contaminants from leaving the body of the mask. Each mask illustrated includes a filter body 16 or filter portion 18 for filtering out harmful matter.

Preferably, each of the masks illustrated fit the face of the wearer 12 in a substantially sealed engagement causing the air inhaled and exhaled by the wearer 12 to pass primarily through the filter body 16 or filter portion 18 of the mask. Fan 14 is particularly useful in such an arrangement to aid air passage through the filter media.

Figure 2:
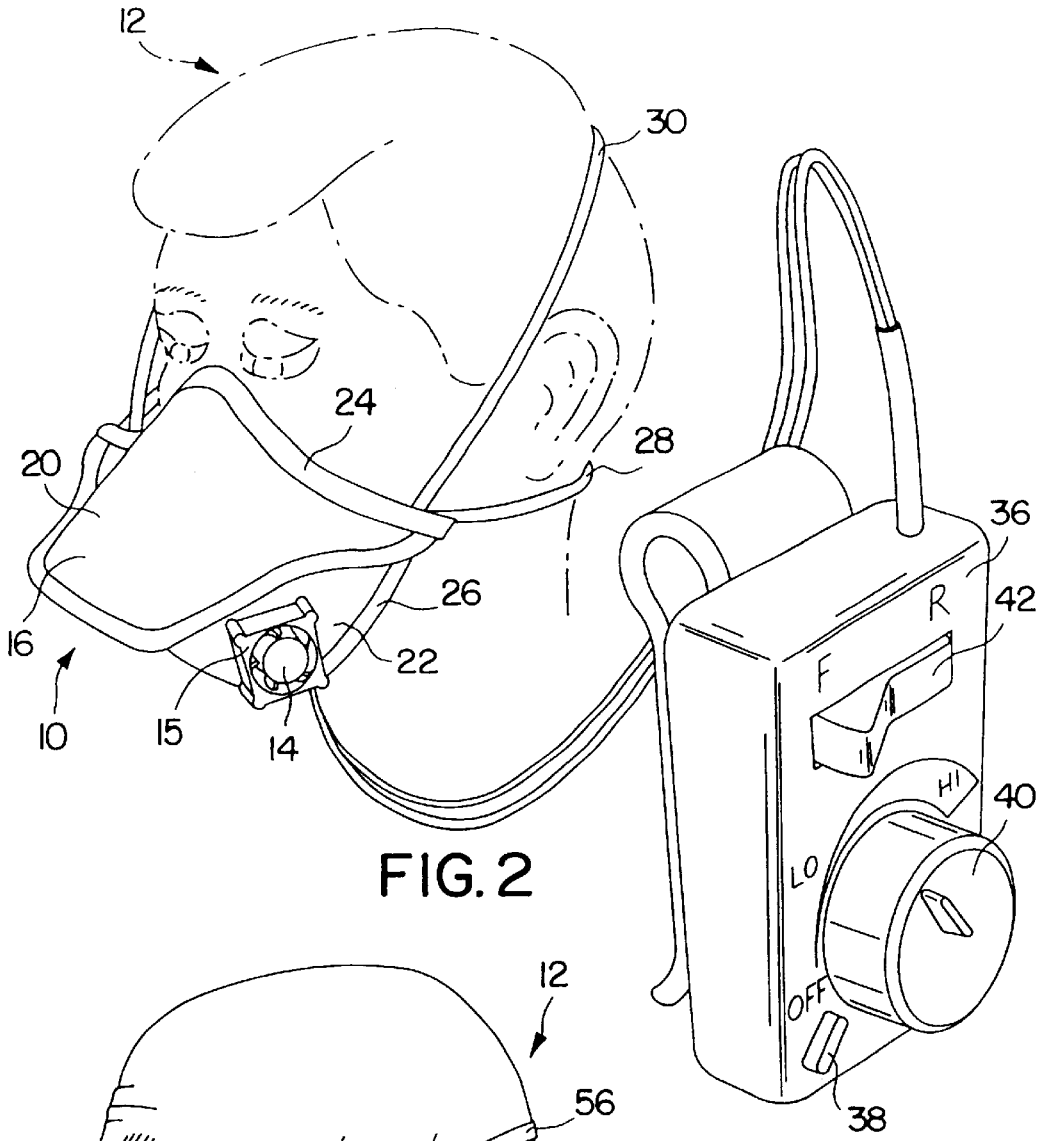
FIG. 2 is a perspective view of the face mask illustrated in FIG. 1, further showing a fan controller.

As illustrated in FIGS. 1A and 2, the filter body 16 of face mask 10 may comprise an upper panel 20 and a lower panel 22 of generally trapezoidal shape. The upper panel 20 and the lower panel 22 may have an identical configuration and may be bonded together along three sides. The fourth, unbonded side of the upper panel 20 comprises the top edge 24 of the mask and extends across the nose and cheeks of the wearer 12. Similarly, the fourth, unbonded side of the lower panel 22 comprises the bottom edge 26 of the periphery or opening of the face mask 10 and is positioned beneath the chin of the wearer 12. Such a mask is described in U.S. Patent Reexamination Certificate B1 5,322,061, issued on Jun. 2, 1998, for U.S. Pat. No. 5,322,061, issued to Brunson on Jun. 21, 1994, the entire disclosure of which is hereby incorporated by reference.

As illustrated in FIGS. 1A and 2, the filter body 16 of face mask 10 is held against the wearer's face by a securement means or mechanism which preferably causes the periphery of the mask to form a substantially tight seal with the wearer's skin. The securing mechanism may comprise resilient, elastic straps 28 and 30 extending respectively from top edge 24 and bottom edge 26 of the periphery of the mask in a generally linear configuration. As can be seen, strap 28 extends behind the head of the wearer 12, and strap 30 extends around the top of the head of the wearer 12 to secure the mask to the wearer's face in a substantially tight engagement. This type of securing mechanism is but one of any number of well known devices that may be used with the present invention.

Figure 1B:
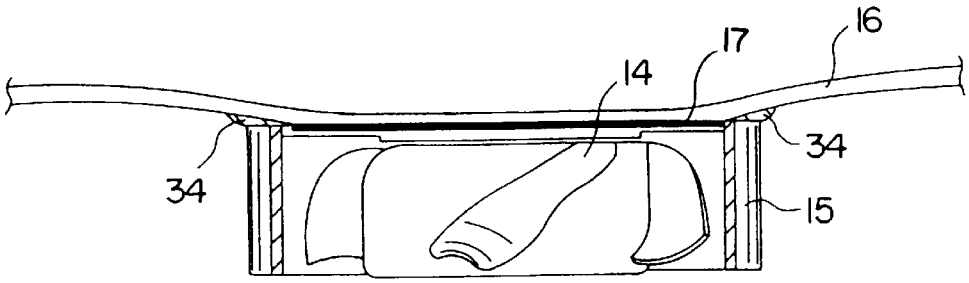
FIG. 1B is a sectional side view of the fan as attached in the embodiment of the device illustrated in FIG. 1A.

As further illustrated in FIGS. 1A, 1B and 2, the present invention incorporates a fan 14 into the face mask described above in a preferred embodiment. Fan 14 may be a simple lightweight fan in plastic casing 15. Applicant has found that a suitable fan is the type as may be provided for cooling in a computer hard drive. The fan 14 can be disposable, semi-disposable, or reusable. The fan 14 may run at a number of speeds or only a single speed. In a preferred embodiment, fan 14 is attached to the lower panel 22 of face mask 10 to most efficiently draw out exhaled air as it enters the interior volume of the mask from the nose and mouth of the wearer 12.

In a desired embodiment, the fan is operational in a direction to draw exhaled air from within the interior volume of the mask 10, in order to enhance breathability and comfort to the wearer 12. Alternatively, the fan 14 may be reversible to allow the wearer 12 to switch the direction of the fan, choosing between a direction to remove exhaled air from the interior volume of the mask 10 or a direction to draw cool, fresh air into the interior volume of the mask 10. Fan 14 could be restricted to one direction as necessary, for example, in a hazardous environment where forcing exterior air into the mask might also bring in harmful matter.

The fan 14 may be attached to the mask 10 in any number of ways. Fan 14 may be permanently attached to the mask 10 with adhesive 34 or the like as illustrated in FIG. 1B. Alternatively, the fan may be removably attached, for example, using a snap-in method, a pocket of material, or with material hooks such as Velcro®. Such a removable attachment arrangement would allow the use of a reusable fan with a disposable mask. In some environments, it will be preferable that both the mask and the fan be disposable.

Fan 14 may also include an air filter 17 to aid in filtering the air forced through the filter media of the mask. The portion of the mask 10 adjacent fan 14 may be formed from different material than the rest of the filter body 16 or filter portion 18. For example, the filter media may be altered to allow increased air flow in that area only. The inclusion of an air filter 17 with fan 14 would be useful in such an arrangement. Similarly, an additional air filter would be helpful if mask 10 is configured with a opening (not shown) allowing fan 14 to be sealed into the periphery of the opening.

In the embodiment illustrated in FIG. 2, fan 14 is connected to a fan controller 36. The controller 36 may include an on/off switch 38, a mechanism 40 for controlling the speed of the fan, and a switch 42 to select the direction of the fan 14, in the case of a reversible fan.

As is illustrated in FIG. 2, the fan controller 36 may be separate from the fan 14 which would be preferred to prevent additional weight on the face mask. This arrangement would allow the wearer 12 to position the controller 36 away from the fan 14 and mask 10, for example, by hooking the controller 36 to another part of the wearer's clothing.

The controller 36 may also include a power supply (not shown) for the fan 14, for example, a battery pack. Alternatively, the power supply for the fan 14 could be a remote fixed supply such as an electrical outlet or other electrical sources.

Figure 3:
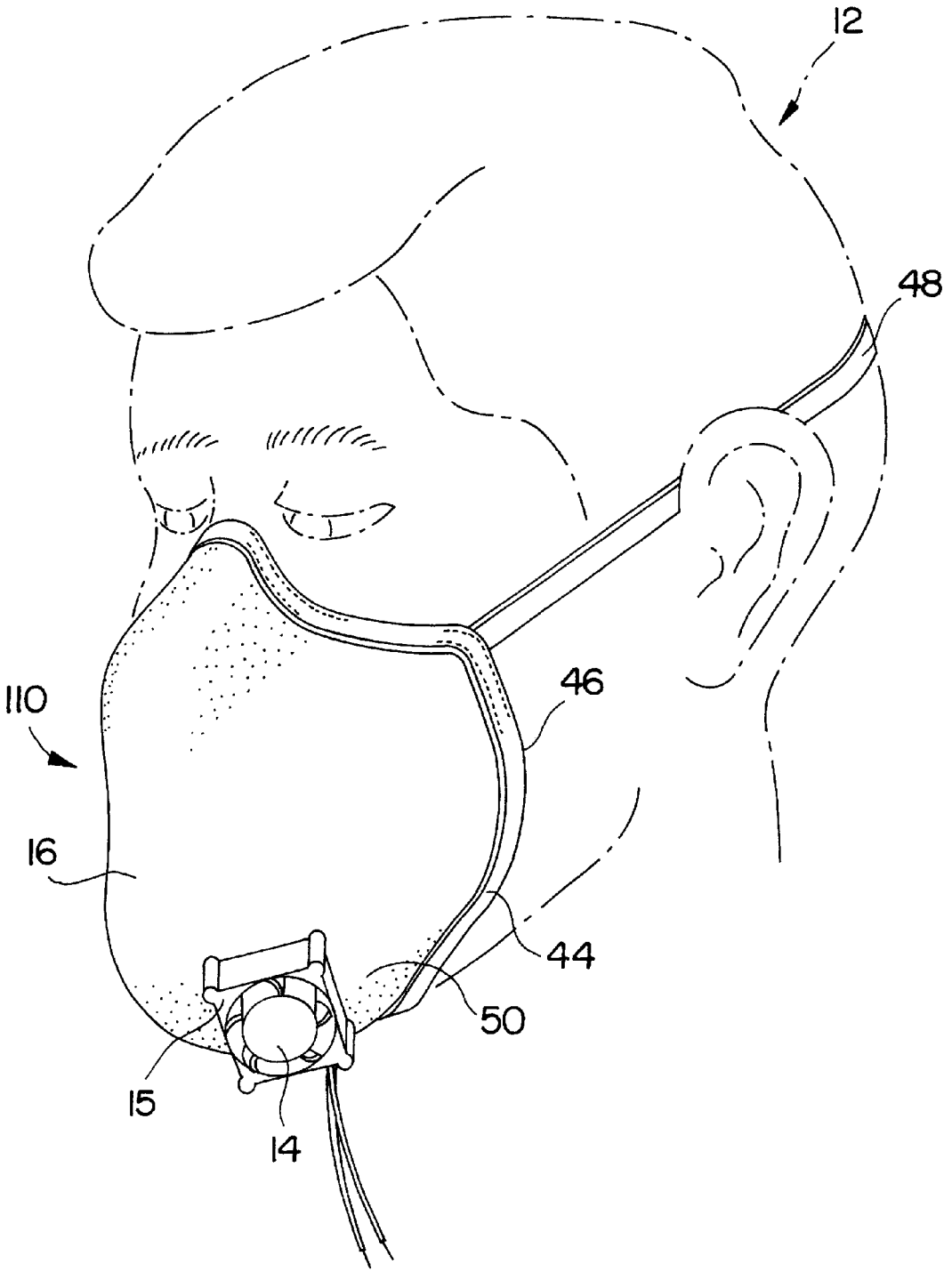
FIG. 3 is a perspective view of another embodiment of a face mask with fan attachment designed in accordance with the present invention.

An alternative embodiment for the present invention is illustrated in FIG. 3. Mask 110 is a traditional cone mask, well-known in the art. Cone mask 110 is defined by a border 44 defining the opening 46 of the mask and molded to fit snugly around the nose, cheeks, and chin of wearer 12. Attaching strap 48 works in conjunction with border 44 to ensure a close fit and minimize the passage of air around the edge of mask 110. Fan 14 may be positioned anywhere on the filter body 16 of cone mask 110. In a preferred embodiment, the fan is positioned on the lower portion 50 of mask 110 for more efficient removal of exhaled air.

Figure 4:
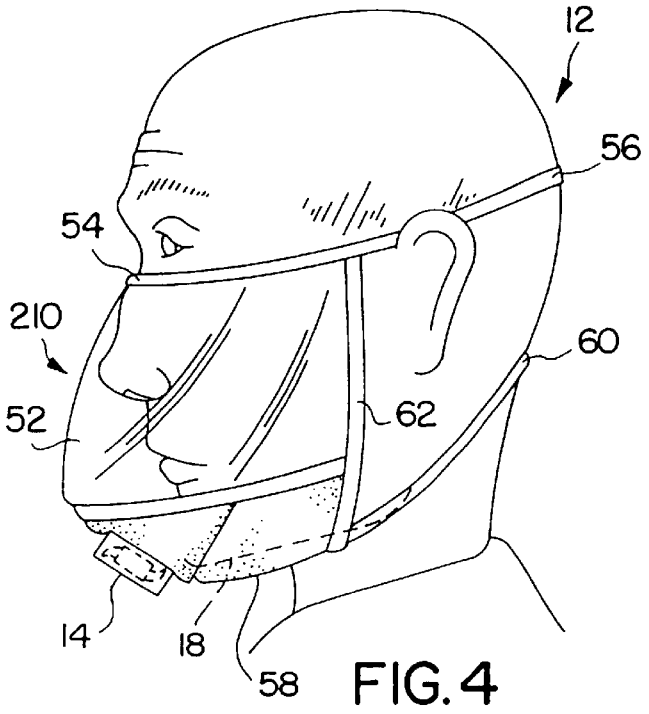
FIG. 4 is a perspective view of another embodiment of a face mask with fan attachment designed in accordance with the present invention.

FIG. 4 illustrates another preferred embodiment of the present invention and shows the use of fan 14 on a face mask 210 with a transparent portion 52. Fan 14 can be particularly beneficial when used with such a mask because fan 14 can facilitate the removal of warm, moist exhaled air, thus preventing condensation from forming on the transparent portion 52. Face masks 210 with a transparent portion 52 allow the wearer's mouth to be seen from outside the mask, allowing the wearer 12 to communicate more easily. Such a mask is described in U.S. Pat. No. 5,561,863, issued to Carlson, II on Oct. 8, 1996, the entire disclosure of which is hereby incorporated by reference.

As shown in FIG. 4, mask 210 may have a top edge 54 extending across the nose of the wearer 12 and further forming an attaching strap 56 positioned around the wearer's head. Mask 210 also has a bottom edge 58 extending under the chin of the wearer and further forming an additional attaching strap 60 which extends around the head or upper neck of the wearer 12. To complete the periphery of mask 210 surrounding the nose and mouth of the wearer 12, side edges 62 connect the top edge 54 and the bottom edge 56.

The body of mask 210 consists of a transparent portion 52 which allows viewing of at least the mouth of the wearer and a filter portion 18 forming the lower portion of mask 210. In a preferred embodiment, fan 14 is attached to the filter portion 18 of mask 210 and, as described above, operates to draw air through the filter portion 18.

While preferred embodiments of the present invention have been described above, it is to be understood that any and all equivalent realizations of the present invention are included within the scope and spirit thereof. Thus, the embodiments depicted are presented by way of example only and are not intended as limitations upon the present invention. While particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

What is claimed is:

1. A face mask, comprising:

a filter body having a shape so as to cover at least the nose and mouth of a wearer, said filter body defined by peripheral edges, said filter body being breathable so that the wearer inhales and exhales through said filter body;

said peripheral edges configured for substantially sealing engagement against the wearer's skin;

said filter body further comprising an exterior surface, and an interior surface defining an interior air volume adjacent the wearer's nose and mouth;

a securing mechanism attached to said filter body and configured to hold said filter body on the wearer's skin; and a fan configured directly against said exterior surface of said filter body so that when operated said fan draws at least a portion of its air flow directly through said filter body thereby communicating with said interior air volume through said filter body.

2. The mask as in claim 1, said securing mechanism configured to hold said peripheral edges in substantially sealing engagement with the wearer's skin.

3. The mask as in claim 1, wherein said fan is operational in a direction to draw air exhaled by the wearer from within said interior air volume.

4. The mask as in claim 1, wherein said fan is reversible so as to draw air out of said interior air volume or force air into said interior air volume.

5. The mask as in claim 1, further comprising a power supply for said fan.

6. The mask as in claim 5, wherein said power supply is portable.

7. The mask as in claim 5, wherein said power supply is remotely positionable on the wearer away from said filter body and fan.

8. The mask as in claim 1, wherein said filter body is formed at least in part of a transparent material so that the wearer's mouth can be seen through said mask, said fan configured to draw moist exhaled air from within said interior air volume.

9. The mask as in claim 1, further comprising a fan controller remotely positionable from said fan, said controller controlling any combination of speed and direction of said fan.

10. The mask as in claim 9, said fan controller further comprising a power supply for said fan.

11. The mask as in claim 1, wherein said fan is substantially permanently secured to said exterior surface.

12. The mask as in claim 1, wherein said fan is removably secured to said exterior surface.

13. The mask as in claim 1, said filter body further comprising an upper portion having a top edge arranged to extend across the nose of the wearer and a lower portion having a bottom edge arranged to extend under the chin of the wearer, said fan disposed on said lower portion.

14. The mask as in claim 13, wherein said upper and lower portions comprise generally trapezoidal shapes joined together along the remaining edges extending from said top edge and said bottom edge.

15. The mask as in claim 1, further comprising at least one passage defined through said filter body adjacent said fan so that said fan draws at least a portion of air through said passage uninhibited by said filter body.

16. The mask as in claim 1, wherein said filter body is formed at least in part of a gas permeable material, said fan attached to said gas permeable material for drawing air therethrough.

17. The mask as in claim 1, said fan further comprising an air filter.

18. The mask as in claim 17, wherein said air filter is positioned directly adjacent said exterior surface of said filter body.

19. A disposable face mask, comprising:

a filter body configured to cover the nose and mouth of a wearer, said filter body having a top edge arranged to extend across the nose of the wearer and a bottom edge arranged to extend under the chin of the wearer, said filter body being breathable so that the wearer inhales and exhales through said filter body;

said filter body having an exterior surface and an interior surface for positioning adjacent the wearer and defining an interior air space proximate the wearer's nose and mouth;

said filter body further comprising an upper portion defined by a top edge configured for substantially sealing engagement against the wearer's skin, and a bottom portion defined by a bottom edge configured for substantially sealing engagement against the wearer's skin; and a controllable powered fan attached directly against said exterior surface of said filter body at said bottom portion, said fan disposed to draw air directly through said filter body thereby communicating with said interior air space through said filter body.

20. The mask as in claim 19, wherein said fan is operational in a direction to draw air exhaled by the wearer from within said interior air space.

21. The mask as in claim 19, wherein said fan is reversible so as to draw air out of said interior air space or force air into said interior air space.

22. The mask as in claim 19, further comprising a power supply and controller for said fan which are remotely positionable from said fan on said wearer.

23. The mask as in claim 19, wherein said upper and lower portions comprise generally trapezoidal shapes and share a common sealed edge.

* * * * *